US008982676B2

(12) United States Patent
Butler

(10) Patent No.: US 8,982,676 B2
(45) Date of Patent: Mar. 17, 2015

(54) GOLFING ACCESSORY TIME PIECE

(76) Inventor: Gary Butler, Macclesfield (GB)

( * ) Notice: Subject to any disclaimer, the term of this patent is extended or adjusted under 35 U.S.C. 154(b) by 0 days.

(21) Appl. No.: 13/344,012

(22) Filed: Jan. 5, 2012

(65) Prior Publication Data

US 2012/0155226 A1 Jun. 21, 2012

Related U.S. Application Data

(63) Continuation of application No. PCT/GB2010/051123, filed on Jul. 8, 2010.

(30) Foreign Application Priority Data

Jul. 9, 2009 (GB) ..... 0911928.0

(51) Int. Cl.

| | |
|---|---|
| ***G04B 19/00*** | (2006.01) |
| ***G07C 1/22*** | (2006.01) |
| ***A63B 57/00*** | (2006.01) |
| ***A63B 71/06*** | (2006.01) |
| ***G04B 47/06*** | (2006.01) |

(52) U.S. Cl.

CPC ..... *G07C 1/22* (2013.01); *A63B 57/0018* (2013.01); *A63B 71/0669* (2013.01); *G04B 47/061* (2013.01); *A63B 2243/0029* (2013.01)

USPC ..... 368/223

(58) Field of Classification Search

CPC ..... G04F 3/00

USPC ..... 368/223, 294, 295

See application file for complete search history.

(56) References Cited

U.S. PATENT DOCUMENTS

| | | | |
|---|---|---|---|
| D195,421 | S | 6/1963 | Huguenin |
| 3,271,445 | A | 9/1966 | Bartholome et al. |
| D321,144 | S | 10/1991 | Besson |
| D336,440 | S | 6/1993 | Favre |
| 5,216,641 | A | 6/1993 | Hoel |
| D349,653 | S | 8/1994 | Giardiello |
| 5,386,990 | A | 2/1995 | Smith |
| D362,192 | S | 9/1995 | Hitter |
| 5,523,985 | A | 6/1996 | Nixon |
| 5,550,884 | A | 8/1996 | Berney |
| D377,907 | S | 2/1997 | Burgener |
| D406,783 | S | 3/1999 | Giardiello |
| D415,043 | S | 10/1999 | Fichter |

(Continued)

OTHER PUBLICATIONS

International Search Report and written opinion for PCT/GB2010/051123 dated Oct. 27, 2010.

(Continued)

*Primary Examiner* — Amy Cohen Johnson

*Assistant Examiner* — Jason Collins

(74) *Attorney, Agent, or Firm* — Woodard, Emhardt, Moriarty, McNett & Henry LLP

(57) ABSTRACT

A golfing time-keeping apparatus is arranged to indicate time of day using a clock face and a movement which has at least a minute hand arranged to complete a revolution of the clock face every hour. The time piece includes a structure for indicating a plurality of subdivisions of a time period longer than 1 hour and shorter than 5 hours, the structure comprising an indicator having a plurality of markings arranged for general visual alignment with the minute hand. The markings include a sequence of indicia circumferentially spaced apart and continuing for more than one but no more than five revolutions wherein some of the later indicia in the sequence are interleaved with some of the earlier indicia.

12 Claims, 4 Drawing Sheets

(56) References Cited

U.S. PATENT DOCUMENTS

| | | | | |
|---|---|---|---|---|
| D415,970 | S | 11/1999 | Aellen | |
| 6,033,316 | A | 3/2000 | Nixon | |
| D459,236 | S | 6/2002 | Haquet | |
| 6,724,691 | B1 | 4/2004 | Kaminsky | |
| 6,871,997 | B2 | 3/2005 | Hartmann et al. | |
| D507,984 | S | 8/2005 | Pibouleau | |
| D520,384 | S | 5/2006 | Scheufele | |
| D525,537 | S | 7/2006 | Monachon | |
| D538,184 | S | 3/2007 | Scheufele | |
| D543,886 | S | 6/2007 | Pandel | |
| D576,907 | S | 9/2008 | Calvani | |
| 7,505,374 | B2 * | 3/2009 | Booty et al. | 368/223 |
| D618,118 | S | 6/2010 | Dolce et al. | |
| D640,144 | S | 6/2011 | Tonohori | |
| D640,145 | S | 6/2011 | Goto | |
| D640,146 | S | 6/2011 | Tedeschi | |
| D674,717 | S * | 1/2013 | Butler | D10/128 |
| 2007/0147174 | A1 * | 6/2007 | Jaermann et al. | 368/10 |

OTHER PUBLICATIONS

United Kingdom Search Report GB911928.0 dated Apr. 23, 2010.

* cited by examiner

GOLFING ACCESSORY TIME PIECE

CROSS-REFERENCE TO RELATED APPLICATIONS

This application is a continuation of International Application No. PCT/GB2010/051123 filed Jul. 8, 2010, which claims the benefit of GB 0911928.0 filed Jul. 9, 2009, both of which are hereby incorporated by reference.

The present invention relates to time keeping apparatus.

BACKGROUND

Analogue time keeping apparatus, such as clocks and watches, and the game of golf have been known for centuries. Both believed to date from about the 15th century.

Clocks and watches which divide a day into hours and minutes and tell the time are known. Stopwatches or chronometers are known which allow intervals of time to be measured. More recently, over the last several decades, digital time keeping equipment has become available enabling complex timing to be conducted and bespoke timing programs and apparatus can be created for specific timing tasks. With the advent of computers and programmable timers, essentially any timing problem can be solved by creating a bespoke digital timer.

Despite these advances in horological apparatus no one has yet invented a simple means by which a golfer when playing a round of golf can easily assess their progress against the pace of play guidelines as suggested by the R&A of St. Andrews (Golf's governing body) to avoid the problems of 'slow play'. 'Slow Play' is generally accepted as any round of golf on an 18 hole course taking longer than 4 hours.

Despite the flexibility of digital time keeping equipment, a conventional analogue clock face type display is still generally preferred by many. As well as generally being considered more aesthetically pleasing, such displays allow essentially instantaneous assimilation of the information, are generally more suited to reading from various angles and in various lighting conditions and facilitate interpretation of the significance of the time by a user.

Analogue time keeping devices, typically watches, with additional hands and functions for presenting additional information, for example, seconds, time of day, the date, the seasons of the moon, the state of the tide, or for example a count down timer are known. Watches having a conventional analogue clock face but tailored to particular applications, for example diving or aviation, having additional hands or dials are known. Digital watches with multiple timers and alarms and complex computers and calculator functions are known.

Despite the centuries of development, hitherto there has not been proposed a device which can conveniently measure or sub-divide time intervals spanning multiple hours using a conventional analogue clock face timing device.

SUMMARY OF INVENTION

Aspects and examples of the invention are set out in the appended claims.

The inventor has appreciated that there are circumstances where, in a device having a clock face (which lends itself to being a compact simple and uncluttered, easy-to-read arrangement for telling the ordinary time of day) a mechanism for monitoring progress through a period spanning multiple hours and sub-dividing that period into multiple intervals would be desirable. A particular application of this mechanism is in the field of golf where it is generally desirable to complete a round of 18 holes in a given time to avoid the problems of slow play.

The present invention provides a golfing time keeping apparatus arranged to indicate time of day including an analogue clock face and a movement having at least a minute hand arranged to complete a revolution of the clock face every hour characterised by means for indicating a plurality of subdivisions of a time period wherein the time period is longer than 1 hour and shorter than 5 hours, comprising a mechanism having a plurality of markings arranged for general visual alignment with the minute hand, the markings comprising a sequence of more than 12 and fewer than 24 indicia, circumferentially spaced apart and continuing in sequence for more than one revolution but no more than five revolutions whereby at least some of the later indicia in the sequence are interleaved with at least some of the earlier indicia in the sequence.

In this arrangement, a conventional analogue clock face time piece can be used and the interval can be ascertained from the position of the minute hand relative to the mechanism. Preferably the mechanism is movable relative to the clock face, preferably a rotatable bezel, so that a set point on the mechanism can be aligned with the current position of the minute hand or with a minute marking on the watch face. Optionally, the movement may have means for resetting the minute hand position to correspond to a set start (tee) time. The indicia are preferably arranged substantially in a single annular array. The indicia are preferably located at a substantially constant radial distance from the centre of the annulus (although artistic variations are possible). This provides a compact readily adjustable arrangement and is also aesthetically pleasing.

An advantage of this arrangement is that a timing problem that has only previously been tackled with cumbersome additional timing devices (including software driven devices) can conveniently be solved with conventional analogue timing apparatus without requiring electronic timing software or hardware nor does it require additional mechanical complexity or additional hands. The apparatus movement may of course be electronically or mechanically regulated. Advantageously, time keeping apparatus according to the invention do not require any programming, other than setting the start time by rotating the mechanism. Other examples of timekeeping devices for monitoring the game of golf may require complex programming.

The indicia preferably include indicia corresponding to the sequential holes of a golf course and thus indicate the pace of play.

As can best be appreciated from the figures pertaining to embodiments, the effect of the sequence continuing around the circumference multiple times and interleaving such that some of the later indicia appear "before" earlier indicia provides a superficially arbitrary sequence and it might be expected that the indicia would be meaningless and confusing. However, it has been found that, with such a number of indicia and the number of revolutions, in fact it is readily apparent to a golf player which is the relevant indicia to compare with the minute hand. In a golfing timepiece the user will be aware of the hole being played (the point in the sequence) and the look to the indicia for that hole is natural, giving an instant visual indication of time remaining or whether the time for that hole has been exceeded.

A particular problem with a golfing timepiece, discussed in more detail below, is that simply dividing the typical time allowed for a golf game equally into the number of holes would produce an unworkable arrangement of indicia. For example with the position of the indicia on later revolutions being too close to that on preceding revolutions so that the indicia are bunched together. The inventor has appreciated that by slightly adjusting the intervals and average time period to be marginally less than typically suggested for a golf game and by including an additional start indicia or index marker, it is possible to generate a sequence which fits conveniently around the circumference, provides generally equal intervals between indicia and provides a time period corresponding very closely to that suggested but within the desired period. This means that a player following the intervals maintains a pace of play and therefore avoids problems associated with slow play.

Also as the indicia on the mechanism are spaced around it this gives some flexibility in the average time interval for each hole with a minimum and maximum time window to play each hole. As all 18 hole golf courses are different this flexibility allows the same preferred arrangement to be used effectively and pragmatically on the vast majority of golf courses in the world.

In a preferred arrangement, the invention provides a golfing timepiece for providing timing indications for each hole of an 18 hole course having a circumferentially arranged sequence of 19 indicia in which there are 3 interleaving indicia between sequential indicia. Preferably the indicia are arranged in a sequence comprising 5, 10, 15, 1, 6, 11, 16, 2, 7, 12, 17, 3, 8, 13, 18, 4, 9, 14, and a final additional indicia. It will be appreciated that the arrangement is circular, with the final additional indicia between the 14 and the 5, so the start point may be defined at any chosen point on the conventional analogue watch face. Such an arrangement will provide for a game lasting approximately 3 hours 50 minutes which conforms to the R&A guidelines. Preferably the indicia are substantially equally circumferentially spaced at approximately 19 degrees apart.

However, some jitter in spacing and thus timing is permissible. The marks between indicia are preferably between 10 and 30 degrees, more preferably between 15 and 25 degrees apart. Where a course has unusually complex holes, a customised mechanism may be provided with unequal spacing for the course. The mechanism may be removable and replaceable with another mechanism.

In a preferred arrangement, the timepiece comprises a watch with the mechanism being a bezel. In other embodiments, the timepiece may comprise a clock. A further aspect of the invention provides a bezel for a watch comprising any sequence of indicia herein.

BRIEF DESCRIPTION OF THE DRAWINGS

Examples of the invention will now be described in greater detail with reference to the accompanying drawings in which:

Elements in the drawings are marked with reference numerals and like numerals are used to identify like elements. In particular each of the drawings FIGS. 1A, 2, 3 and 4 each depict a rotatable watch bezel 100 which is mounted on a watch face 200 having a minute hand 300. As shown in FIG. 1B, time pieces of the present disclosure comprise a movement 301 including at least the minute hand 300. As shown in FIGS. 1A and 1B the bezel 100 encircles the clock face and the outer tip of the minute hand.

DESCRIPTION OF THE PREFERRED EMBODIMENT

Figure 1A:
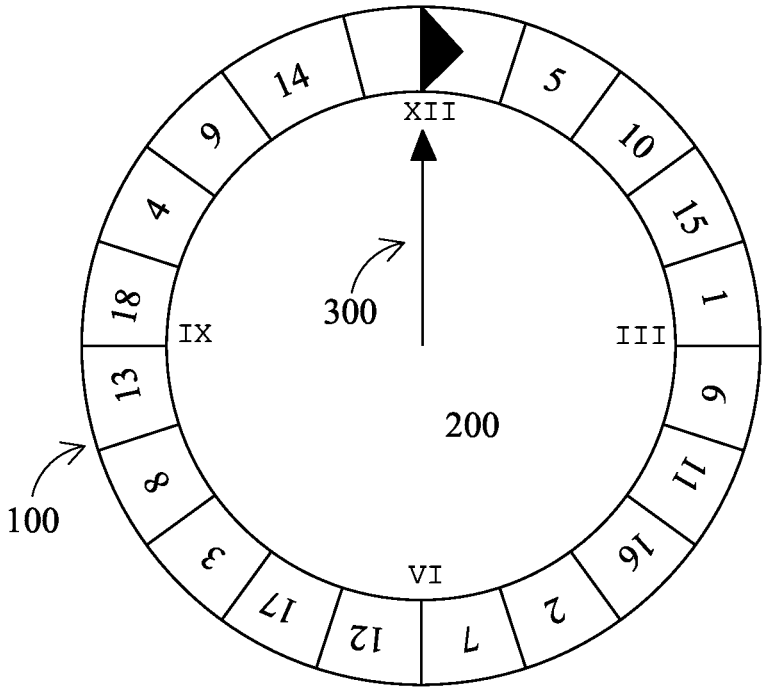
FIG. 1A shows a watch face with a bezel according to a first embodiment (18 hole version)
Figure 1B:
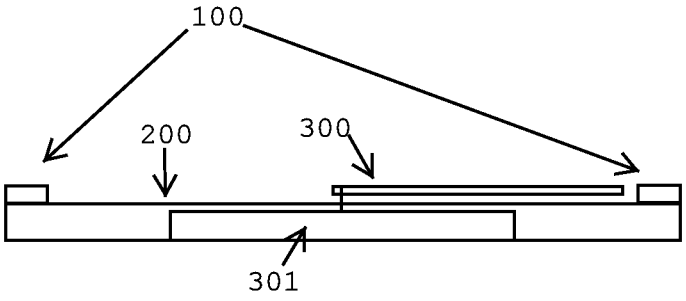
FIG. 1B shows a schematic section view of the corresponding time piece.

The watch depicted in FIG. 1A is shown in a preferred arrangement with the bezel divided into 19 segments. Preferably 18 of the 19 segments are marked with numerical indicia numbered from 1 to 18. Each numerical indicia corresponds to a hole on a 18 hole golf course. This indicia may be a numeric or alpha numeric or a non numeric or other symbolic indicator. An additional $19^{th}$ segment is marked with an indicia which does not necessarily correspond to a hole on a golf course such as a marker, spacer or graphic device. In this example the 19th segment bears a flag motif to promote ease of use by a wearer and to facilitate accurate positioning of the watch bezel at the start of play. The flag is centred such that alignment is with the start tee time and this 'sets' the watch for a round of golf. The minute hand then tracks the pace of play in accordance with the guidelines issued by the R&A of approximately 3 hours 50 minutes. The division between the indicia for holes 7 and 12 is preferably placed exactly at 180 degrees which corresponds to the 30 min point on a watch.

In the example of FIG. 1A the rotatable watch bezel 100 is divided into 19 equal segments. Each segment of the rotatable watch bezel occupies 18.95 degrees which corresponds to approximately 3 minutes 9.5 seconds. This enables indicia corresponding to consecutive holes of a golf course to be placed 4 segments apart at 12 minute, 38 seconds average intervals.

The selected average time interval of 12 minutes 38 seconds is 8 seconds faster than the recommended average time allocated for each hole of a golf course by golf's regulatory bodies (which is 12 minutes 46 seconds). However, this minor differential is well within the measurement accuracy achievable from observation of a minute hand of a watch and within the tolerance of any manufacturing accuracy of the mechanism. Therefore we have surprisingly found that, in spite of this 8 second differential a rotatable watch bezel divided into 19 segments provides an acceptable level of accuracy and helpfully avoids the problems of clashing subsequent indicia.

The sequence of golf hole indicia on the watch bezel has been determined on the basis of the total maximum suggested time taken to complete 18 holes of a golf course, but based on the appreciation that in fact it may be possible to provide generally equal hole spacing (which is considered desirable) and by making adjustments to the precise time required.

Also the nature of this segment design is such that whilst the average time to play each hole is 12 minutes 38 seconds, the range of timings determined by the width of the segment with the relative indicia for that hole is between approximately 11 and 14 minutes. This flexibility allows this same preferred arrangement to be used effectively and pragmatically on the vast majority of golf courses in the world.

In FIG. 1A a rotatable watch bezel is designed to provide a 3 hour 50 minute game of golf and indicia are marked on the watch bezel in a sequence corresponding to 5, 10, 15, 1, 6, 11, 16, 2, 7, 12, 17, 3, 8, 13, 18, 4, 9, 14, 19. Where the additional indicia, 19, corresponds to the end or spacer marker which is added to the sequence of indicia on the watch bezel.

By way of background, it can be appreciated that if a circular mechanism is simply divided into 18 segments of 20 degrees, the interval for each segment is then 3 minutes and 20 seconds. Firstly these would mean that the total time to play a round of golf would exceed the guidelines suggested by the R&A. Secondly hole intervals at 13 minutes 20 seconds, 26 minutes 40 seconds, 40 minutes, 53 minutes 20 seconds, 6 minutes 40 seconds, 20 minutes, 33 minutes 20 seconds 46 minutes 40 seconds 0 minutes 0 seconds correspond to the first 9 holes however all subsequent indicia will clash (i.e. different indicia corresponding to the hole numbers will need to be assigned to the same segment of the mechanism). In this example numbers start to 'clash' on the same segment after 2 hours. Thirdly, whilst it is possible that hole indicia can be placed at 20 degree intervals and arranged for a time interval between holes of 13 minutes 20 seconds within the same hour the time interval is only 10 minutes when the hand crosses the hour marker (4 to 5, 9 to 10, 14 to 15) which is clearly not acceptable.

In other words it is simply not possible to assign a unique position on a watch bezel to each of 18 indicia evenly distributed around it. This suggests on the face of it that it is not possible simply to use static indicia on an analogue watch face to deal with the problem of indicating hole times for a golf course. This is therefore consistent with the fact that the problem has remained unsolved for five centuries and recent attempts to solve the growing problem of slow play have focused on more complex and costly solutions such as digital timers or combinations of peripheral adjuncts such as printing pace of play timings on scorecards.

In other examples different durations of the game may be provided for. For example of approximately 2 hours 50 minutes in which case the sequence of indicia corresponds to 13, 7, 1, 14, 8, 2, 15, 9, 3, 16, 10, 4, 17, 11, 5, 18, 12, 6, 19. Where the indicia, 19, corresponds to the end or spacer marker which is added to the sequence of indicia on the watch bezel. In another example a rotatable watch bezel is designed to provide approximately a 4 hours and 45 minute game of golf and indicia are marked on the watch bezel in a sequence corresponding to 4, 8, 12, 16, 1, 5, 9, 13, 17, 2, 6, 10, 14, 18, 3, 7, 11, 15, 19. Whilst these two examples above are theoretically possible they would be less commonly used in a real game of golf.

Alternative examples are arranged to be adapted for golf courses where the number of holes is exceptional to the standard 18 hole golf course. Whilst the number of courses that these examples would apply to is minimal it does show the knowledge of the inventor and the depth and thoroughness of the thinking behind it.

Figure 2:
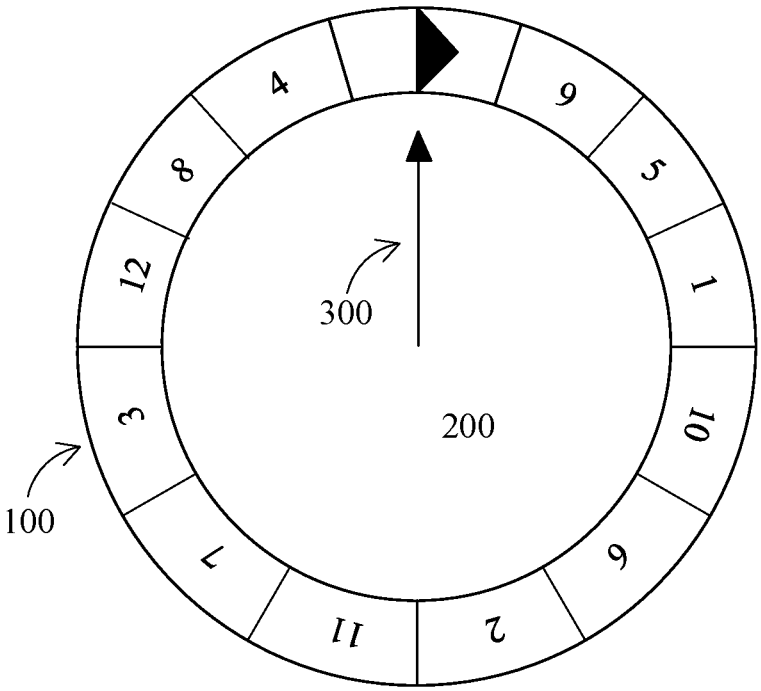
FIG. 2 shows a watch face with a bezel according to a second embodiment (12 hole version)

The "Shiskine" example depicted in FIG. 2 provides for a 12 hole course in approximately 1 hour and 50 minutes. In this example the sequence of indicia is arranged in the sequence 7, 1, 8, 2, 9, 3, 10, 4, 11, 5, 12, 6, 13. Optionally a sequence is arranged to provide a sequence of indicia corresponding to a 12 hole course completed in a total time of approximately 2 hours and 46 minutes, such a time keeping mechanism has a sequence of markers 9, 5, 1, 10, 6, 2, 11, 7, 3, 12, 8, 4, 13.

Figure 3:
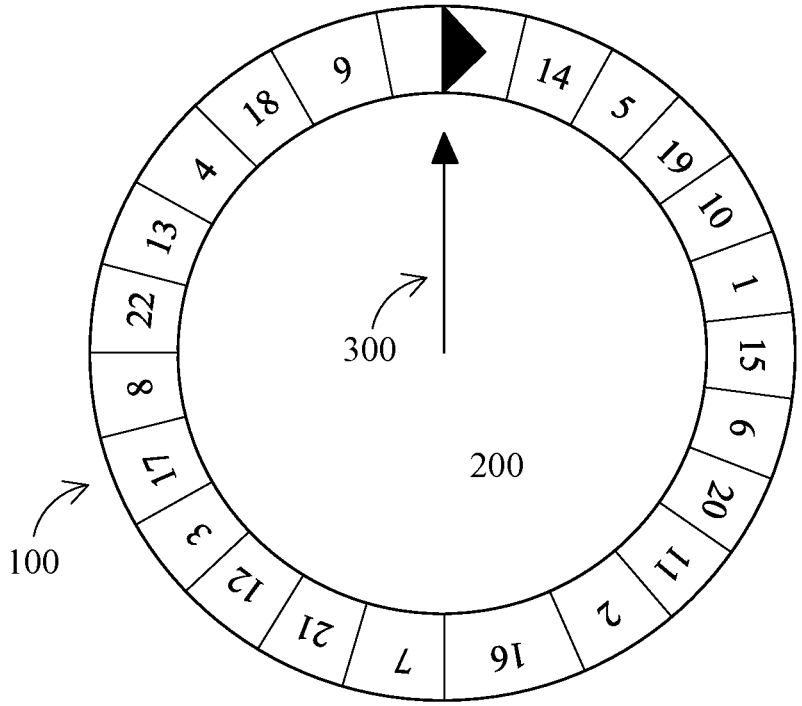
FIG. 3 shows a watch face with a bezel according to a third embodiment (22 hole version)

The example of FIG. 3 illustrates the 'Seaton Carew' example which provides for 22 holes in approximately 4 hours and 47 minutes having indicia in 23 segments arranged in a sequence 14, 5, 19, 10, 1, 15, 6, 20, 11, 2, 16, 7, 21, 12, 3, 17, 8, 22, 13, 4, 18, 9, 23. Again, the additional indicia 23 corresponds to a spacer or information marker segment which is added to the watch bezel.

Figure 4:
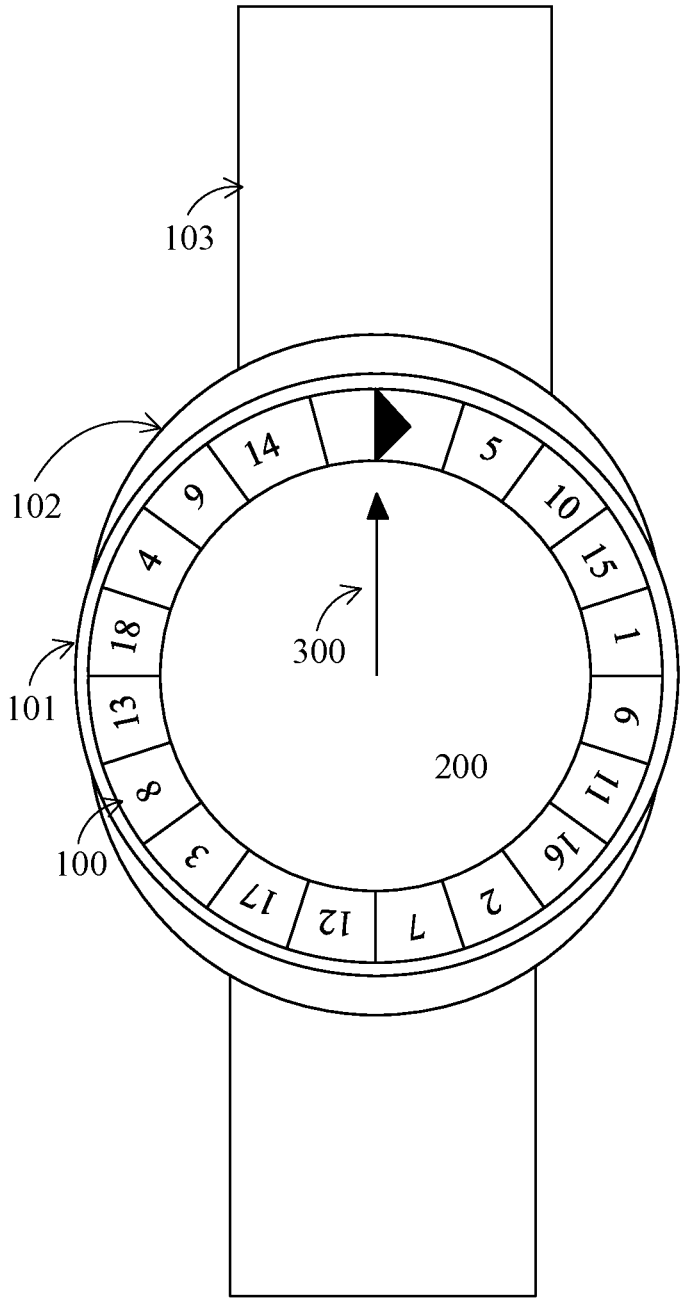
FIG. 4 shows a watch assembly according to a fourth embodiment for an 18 hole version. As will be appreciated in the context of the description contained herein other 12 or 22 hole versions of a watch face with a bezel could be used in a suitable watch assembly.

The example of FIG. 4 shows a watch bezel 100 according to the example of FIG. 1A mounted to a watch assembly 105. The watch assembly includes a rotatable mounting 101 for mounting the bezel 100 to a watch body 102. The watch body 102 is attached to a strap 104. As will be appreciated the watch assembly may include the rotatable bezel 100 of the examples of FIGS. 2 and 3 respectively or any other watch bezel according to any other example of the invention.

Optionally watch bezels and rotatable mountings may be provided with clip fittings so that bezels may be removably fixed to the mountings. In these examples a wearer may interchange watch bezels, for example bezels corresponding to different lengths of courses (as in FIGS. 2 and 3) and/or different lengths of play.

Optionally each indicia may be replaced by a previous indicia such that the indication provided by the minute hand corresponds to the hole started as opposed to the hole completed. In different forms of play it is possible for a user to elect to divide a course into two by setting the start marker to the start tee time and resetting the bezel to the 9 indicia at the start time of the final nine holes (commonly known as the "back 9"). Equally a course may be started at any hole (commonly known as a shotgun start) if the indicia of last hole to be played is set as the start time, for example to begin a course at the sixth hole the fifth indicia is set as the start time.

It will be appreciated that the invention provides a mechanism for dividing an interval which is not a simple number of hours into a number of periods without complex programming. Any complicated programming may detract from user acceptance and distract players from playing the game. Examples of the invention have no complicated moving parts (at most a rotatable mechanism or bezel) which enables them to be robust and reliable. Advantageously examples of the invention are simple to manufacture and require no mechanical development of the watch workings and are durable in operation. Additionally because they require no electronics they do not reduce the battery life of a timekeeping device to which they are attached. Still more advantageously examples of the invention provide a method by which to assess (for example by course marshalls) the progress of any golfer or group of golfers based on their start time and immediately provides a visual indication that a golfer or group of golfers are falling behind the pace of play, without requiring access to special timers or complex calculations. Still more advantageously time keeping devices according to the invention do not need to create noise, beep, or vibrate in order to make time keeping readily apparent which would distract the golfer from play Examples of the invention provide a bezel design applicable to any watch or clock face with a bezel and a minute hand. In the example of FIG. 1A a bezel suitable for a wrist watch is shown, as will be appreciated by the skilled practitioner, with appropriate modifications examples of the invention can be applied to a clock or to a pocket-watch type pendant for attachment to a golf bag, as a pitch marker incorporating a watch face, or in any other appropriate time keeping device having a rotating hand with a period of one hour.

The examples described herein relate in particular to the game of golf but these examples are to be understood as illustrative of an application of the invention and should not be construed to limit the scope of the invention. As will be appreciated the invention may be applied in any circumstance in which it is necessary conveniently to measure or sub-divide intervals spanning multiple hours using a conventional clock face timing device Examples also provide methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa. Features of aspects of the invention, embodiments, examples and possibilities are illustrative and appropriate combinations of their features may be made to provide solutions to the problem of accurately and simply monitoring the progress of play in a game of golf.

Furthermore, although the preferred embodiment is an analogue mechanical watch, it will be appreciated that the invention may be embodied in a soft clock, specifically an application for a computing device having a processor and display, such as a personal computer, PDA, mobile telephone or the like. As will be appreciated digital devices exist wherein a simulated visual analogue clock can be displayed. Such devices may have a touch sensitive interface or other user interface arranged to permit a user to rotate a graphical representation of a watch bezel around a representation of an analogue clock face. Accordingly the principles of this invention may be applied equivalently in software or hardware.

The inventor has used his extensive knowledge of the history and game of golf to invent an extremely practical and brilliantly simple mechanism that when combined with a conventional analogue watch or clock face enables the user to both tell the time of day and also to identify time of play and thus take personal responsibility for maintaining an acceptable pace of play when playing the game of golf. This has numerous social and economic benefits to the player, the game of golf and the natural environment in which the game is played. The game depends on the player taking responsibility to adhere to the rules and etiquette of the game and this invention helps the golfer to address one of the biggest issues within the modern amateur game today.

The invention claimed is:

1. A golfing time-keeping apparatus for monitoring the time of play for each golf hole being played as part of a round of golf, said golfing time-keeping apparatus comprising:

a timepiece including a clock face and a movement having a minute hand arranged to complete a revolution of the clock face every hour; and a circular bezel constructed and arranged to encircle the clock face and to rotate relative to the clock face, said circular bezel being segmented into a plurality of equally spaced sections, the number of sections being equal to the number of golf holes to be played, plus one;

wherein the sections include golf hole number indicia indicating golf hole numbers of a golf course played as part of a round of golf; and wherein the indicia are arranged on the bezel so that a time for play to end for a golf hole is indicated as the minute hand passes the section with hole number indicia corresponding that golf hole.

2. The golfing time-keeping apparatus according to claim 1 wherein the golf hole number indicia is arranged so that some indicia later in the sequence are interleaved with at least some indicia earlier in the sequence.

3. The golfing time-keeping apparatus according to claim 2 wherein the golf hole number indicia are arranged in a singular annular array.

4. The golfing time-keeping apparatus according to claim 2 wherein the golf hole number indicia are arranged for providing timing indications for each hole of an 18 hole course, the apparatus having a circumferentially arranged sequence of 19 indicia arranged in a sequence comprising 5, 10, 15, 1, 6, 11, 16, 2, 7, 12, 17, 3, 8, 13, 18, 4, 9, 14, and a further index mark.

5. The golfing time-keeping apparatus according to claim 2 wherein the indicia are substantially equally circumferentially spaced at approximately 19 degrees apart.

6. The golfing time-keeping apparatus according to claim 2 wherein the indicia are arranged for providing timing indications for each hole of a 12 hole course, the apparatus having a circumferentially arranged sequence of 13 indicia arranged in a sequence comprising 7, 1, 8, 2, 9, 3, 10, 4, 11, 5, 12, 6, and a further index mark.

7. The golfing time-keeping apparatus according to claim 2 wherein the indicia are arranged for providing timing indications for each hole of a 22 hole course, the apparatus having a circumferentially arranged sequence of 23 indicia arranged in a sequence comprising 14, 5, 19, 10, 1, 15, 6, 20, 11, 2, 16, 7, 21, 12, 3, 17, 8, 22, 13, 4, 18, 9, and a further index mark.

8. The golfing time-keeping apparatus according to claim 1 wherein numerically sequential golf hole number indicia are separated by other golf hole number indicia.

9. The golfing time-keeping apparatus according to claim 1 comprising a wristwatch.

10. The golfing time-keeping apparatus according to claim 1 comprising a clock.

11. The golfing time-keeping apparatus according to claim 1 comprising a software application for a device having a processor and a display, the software application comprising code for drawing a clock face, code for performing timing to generate a moving minute hand and code to display a sequence of indicia around the circumference of the clock face.

12. A golfing time-keeping apparatus for monitoring the time of play for each golf hole being played as part of a round of golf, said golfing time-keeping apparatus comprising:

a timepiece including a clock face and a movement having a minute hand arranged to complete a revolution of the clock face every hour; and a circular bezel constructed and arranged to encircle the clock face and to rotate relative to the clock face, said circular bezel being segmented into a plurality of equally spaced sections, wherein each equally spaced section comprises a numerical sequence of golf hole number indicia so that at least some indicia later in the sequence are interleaved with at least some indicia earlier in the sequence, thereby enabling the minute hand and the bezel together to indicate the time of play for sequential holes of a golf course being played as part of the round of golf.

* * * * *